United States Patent [19]

Sharychenkov

[11] 3,952,491

[45] Apr. 27, 1976

[54] OPEN-END SPINNING FRAME

[76] Inventor: Alexandr Alexeevich Sharychenkov, Ternovka, ulitsa Experimentalnaya, 1, kv. 67, Penza, U.S.S.R.

[22] Filed: June 21, 1974

[21] Appl. No.: 481,822

[52] U.S. Cl. ..... 57/34 R; 57/58.95; 57/78; D01H/1/32

[51] Int. Cl.[2] ..... D01H 1/12

[58] Field of Search ..... 57/34 R, 58.89–58.95, 57/78, 79, 92

[56] References Cited

UNITED STATES PATENTS

| | | | |
|---|---|---|---|
| 3,695,017 | 10/1972 | Hori et al. | 57/34 R |
| 3,802,176 | 4/1974 | Stahlecker | 57/58.95 X |
| 3,807,158 | 4/1974 | Landughrkamp et al. | 57/58.95 |
| 3,810,352 | 5/1974 | Miyazaki et al. | 57/34 R |
| 3,854,274 | 12/1974 | Bartling | 57/34 R |
| 3,858,385 | 1/1975 | Shinkai et al. | 57/34 R |
| 3,874,154 | 4/1975 | Stahlecker et al. | 57/58.95 |

*Primary Examiner*—John Petrakes
*Attorney, Agent, or Firm*—Holman & Stern

[57] ABSTRACT

An open-end spinning frame which can most advantageously be employed for spinning heavy yarns. The frame incorporates a plurality of spinning arrangements, each comprising a feeding arrangement, a twister, a yarn delivery motion and a building motion as well as a motion for their simultaneous disconnection and sequential actuation. The frame is simple in design and has a high operating efficiency.

6 Claims, 8 Drawing Figures

OPEN-END SPINNING FRAME

BACKGROUND OF THE INVENTION

The present invention relates to spinning frames, and, more particularly to open-end spinning frames which comprise rotary twisters provided with means for yarn pressing in the course of its formation and which can most advantageously be employed to produce heavy or thick yarns. The invention can be also used in frames wherein the process of spinning is effected by means of an electric field of high intensity.

PRIOR ART

There exist prior art open-end spinning frames, which comprise a plurality of spinning arrangements, each of which incorporates a combing drive roll, a feed roller coupled with a drive via a clutch, a rotary twister with provision for yarn pressing in the course of its formation (e.g. a ball or a projection in the twister channel), a motion for retracting the flexible coupling from the twister shaft, a yarn delivery motion providing for the delivery of the yarn out of the twister through the channel provided in the twister shaft, a building motion with a brake member, and a yarn tension pickup lever (cf. FRG Pat. No. 1,560,313).

These prior art frames, however, have no provision for a simultaneous disconnection of the drives of all motions of a spinning arrangement in case of a breakage, nor for their sequential actuation depending on the specific process of yarn production. In the known frames, should there be a breakage, only the drive of the feed roller is stopped in any spinning arrangement, thereby arresting fiber feeding into the twister, for the yarn tension pickup lever is electrically connected only to the clutch transmitting rotation from the frame drive shaft to the feed roller.

It is likewise known to employ an open-end spinning frame, in which each spinning arrangement comprises, apart from the above-listed motions, a housing hinged on the frame and accomodating a feed roller, a combing drive roll, a rotatably pivoted twister and a yarn tension pickup lever (cf. U.S.S.R. Inventor's Certificate No. 217,243). In this frame, each spinning arrangement incorporates motions for reversing the drives of the yarn delivery motion, the building motion and the drive shaft of the feed roller in order to stop fiber feeding into the twister in case of a breakage. Each reversing motion comprises a roller coupled with the drive shaft via a carrier with gears engaging the gear on the drive shaft and the gear on the roller, as well as means, e.g. an electromagnet or a throw-over catch, cooperating with the carrier to stop its rotation together with the drive shaft, thereby reversing the direction of the roller rotation. The latter means is controlled by the yarn tension pickup lever, the reversing motions operating only when the yarn breaks in the delivery channel of the twister shaft and its end is clamped by a special member of the yarn tension pickup lever. As said drives are reversed, the yarn approaches the orifice of the delivery channel and is drawn pneumatically into the twister, with the yarn tautening and the pickup lever responding to the tension by actuating the electromagnets, which throw in the feed roller drive clutch, to change over the drives of the delivery and building motions from reverse to forward motion. As a result, the fibers fed into the twister are pieced-up with the yarn delivered out of the twister and wound on a package.

Should a breakage occur between the delivery channel of the twister and the building motion, the reversing motions fail to provide for automatic yarn feed into the twister, for the end of the yarn is not clamped by the special member of the yarn tension pickup lever.

In such a case, the drives of all the motions (feed roller, twister, delivery motion and building motion) have to be disconnected and the yarn threaded into the twister. To this end, the twister is rotated about the pivot together with the spinning arrangement housing to retract the twister from its drive and clean it from the remaining fibers and yarn. Then, the twister is set to its initial position, the yarn end brought to the orifice of the delivery channel, threaded into the special member of the yarn tension pickup lever, and the drives of all the spinning arrangement motions are actuated to start the process of spinning again.

However, such a method of automatic yarn threading into the twister in case of a breakage is inapplicable to frames in which the spinning arrangements comprise twisters having a provision for yarn pressing in the course of its formation, for the design of such twisters fail to provide for the drawing of the broken yarn end thereinto while the twister is in rotary motion.

OBJECTS AND SUMMARY OF THE INVENTION

The present invention seeks to provide an open-end spinning frame in which each spinning and has a provision for a simultaneous disconnection of the feed roller, the twister and the building motion 38, and well as for a sequential actuation thereof in keeping with the particular yarn production process requirements, thereby materially improving the operating efficiency of the frame and simplifying the task of the operator.

The above and other objects are attained in that in an open-end spinning frame, comprising a plurality of spinning arrangements, each of which incorporates a combing drive roll, a feed roller coupled with its drive via a clutch, a twister with a motion for retracting the flexible coupling from the twister shaft, a yarn delivery motion, a building motion with a brake member, and a yarn tension pickup lever, in accordance with the invention, each spinning arrangement has a motion for simultaneous disconnection of the feed roller, the twister and the building motion as well as for their sequential actuation, with the latter motion being coupled with the yarn tension pickup lever and controlled thereby, and said motion comprises a bar having a means for positively displacing said bar in a vertical plane and two stops which in the two positions of the bar cooperate with the feed roller drive clutch and with the motion for retracting the flexible coupling from the twister shaft, respectively, and a cylinder, said bar passed through the cavity thereof, which is so mounted as to be able to displace together with the bar to one of the positions thereof for effecting said disconnection, with the cylinder having a stop for cooperating with the brake member of the building motion, and a means for temporarily restraining the cylinder from displacing together with the bar to the position in which the building motion is actuated to restart the process of spinning.

Thus, with each spinning arrangement provided with a mechanism for a simultaneous disconnection and sequential actuation of the feed roller, the twister and the building motion, each spinning arrangement can be controlled and any one stopped, without having to shut down the entire frame. This feature is conducive to a considerable rise in the operating efficiency of the frame.

With the motions of the spinning arrangement actuated sequentially, it is possible to accumulate fibers in the twister which are pieced up with the yarn fed from the building motion, thereby forming the yarn. Actuation of the yarn delivery and building motions as spinning is resumed in the twister permits obtaining a yarn without desirable deviations from the prescribed thickness of the pieced-up portions thereof.

The joint displacement of the bar and the cylinder is preferably provided for by means of a longitudinal slot formed in the cylinder and a pin secured in the bar and received in the cylinder slot.

The invention is characterized in that the means for temporarily restraining the cylinder from displacing together with the bar comprises a catch hinged on the frame, the catch being spring-urged into abutment against the cylinder and having a wedge-shaped projection, and a pusher secured on the bar with the pusher cooperating with the wedge-shaped projection and extending beyond the cylinder through a longitudinal cut-out provided in the latter, and the cylinder having projection with which the catch cooperates, restraining the cylinder as the bar is moving until the pusher retracts the catch from the cylinder projection.

The invention is further characterized in that the means for positively displacing the bar to its disconnection position comprises a gib provided with a roller at one end which is connected with the bar at the other end, a load-bearing member coupled with the gib, and a spring-loaded three-arm lever having a depression formed in the central portion thereof, with the depression serving to receive the gib roller, the three-arm lever having one arm hinged on the frame and another pivotally connected with the armature of an electromagnet which is electrically coupled to the yarn tension pickup lever through a switch.

The invention is also characterized in that the means for positively displacing the bar to the actuation position is defined by as a handle hinged on the frame and resting against the pin secured on the bar.

The invention is likewise characterized in that the cylinder is provided with an auxiliary stop adapted to cooperate with the yarn delivery motion in order to actuate or disconnect it in the course of cylinder displacement.

Thus, due to the motion for actuation and disconnecting the motions of each spinning arrangement, the present spinning frame features a high level of operating efficiency, is easy to operate and maintain, requires no precision instruments for the adjustment of each spinning arrangement, alleviates the burden of manual labor for the operators, and can be handled by medium-skilled operators.

The invention will be better understood by reference to the following detailed description of an open-end spinning frame, in accordance with the invention, taken in conjunction with the accompanying drawings, wherein:

DETAILED DESCRIPTION OF THE INVENTION

Figure 1:
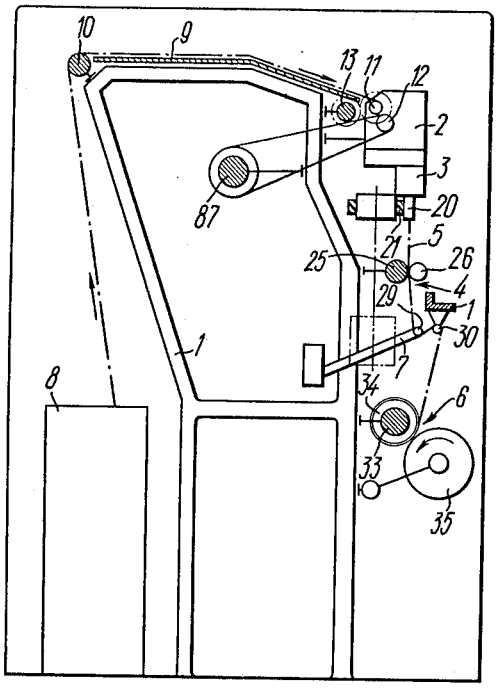
FIG. 1 is a general view of an open-end spinning frame, the view being in side elevation and partly in cross-section.

Referring now to the drawings, it will be seen illustrated therein a plurality of spinning arrangements mounted on a frame 1 (FIG. 1) therealong. Each spinning arrangement comprises a feeding arrangement 2, a twister 3, a motion 4 for delivering a yarn 5 out of the twister 3, a building motion 6, and a pickup lever 7 sensing the tension of the yarn 5, with the elements being mounted one beneath another sequentially in the direction of yarn formation. In order that fibrous material in the form of a sliver or a roving out of which the yarn 5 is subsequently formed in the twister 3 may be fed to the feeding arrangement, there is provided a box 8 for the sliver or the roving, a feeding trough 9 mounted on the frame 1, and a drive shaft 10 delivering the sliver or the roving to the trough 9 leading to the feeding arrangement 2.

Figure 2:
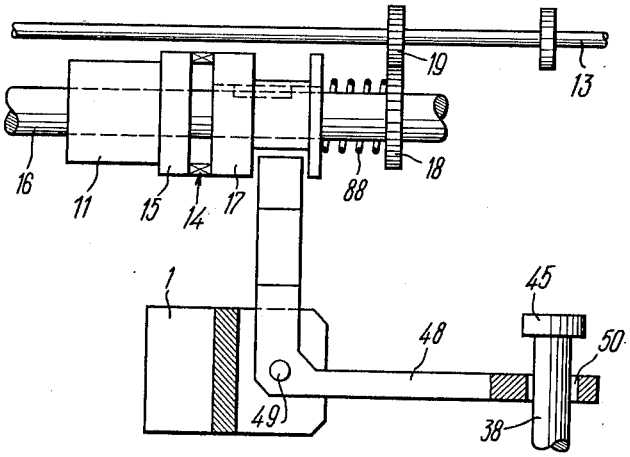
FIG. 2 illustrates a feed roller drive.

The feeding arrangement 2 comprises a feed roller 11, a constantly rotating combing roll 12 and a guide table (not shown) by means of which the fibrous sliver is directed from the feed roller 11 to the combing roll 12. The feed roller 11 is rotated via a jaw clutch 14 (FIG. 2) from a constantly rotating shaft 13 mounted in bearings on the frame 1 and extending the entire length of the frame. One semiclutch 15 of the clutch 14 is mounted on a shaft 16 and connected with the feed roller 11, and the other semiclutch, 17 is connected with a gear 18 meshing with a gear 19 mounted on the shaft 13.

The frame employs a known type of twister 3, defined by a rotor (not shown) provided with a channel for feeding fibers thereinto and delivering the formed yarn therefrom. There is a clamping means (a ball or projection) provided in the twister to condense the yarn as it is being formed. The channel through which the formed yarn is delivered passes through a shaft 20 (FIG. 1) of the twister 3.

Figure 3:
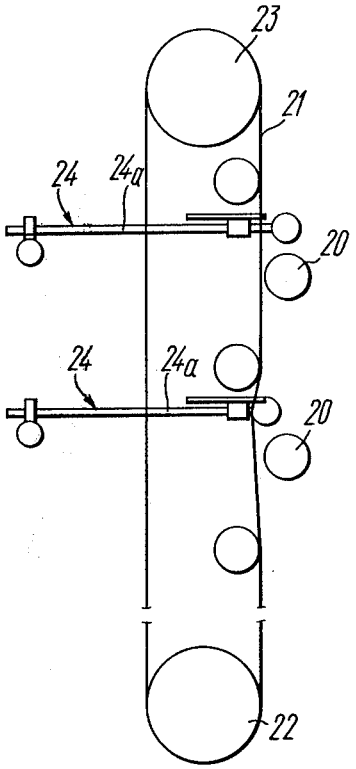
FIG. 3 is a plan view of a twister drive.

The twister 3 is driven into rotation by a flexible coupling 21 (FIG. 3), e.g. a tape or a belt, passing through the entire frame for imparting rotation simultaneously to the shafts of the twisters of all the spinning arrangements. The flexible coupling 21 is entrained about a tension shaft 22 and a drive shaft 23 which actuates the flexible coupling 21. For independent stoppage of each twister 3, the latter is provided with a motion 24 for retracting the flexible coupling 21 from the shaft 20 of the twister 3. The motion 24 may be made in a variety of designs, e.g. as a two-arm lever 24a hinged on the frame 1, and one arm of which cooperates with the flexible coupling 21 to retract the same from the shaft 20 of the twister 3.

The motion 4 (FIG. 4) for delivering the yarn out of the twister 3 is constituted by a constantly rotating shaft 25 extending the entire length of the frame and a roller 26 in permanent contact with the shaft 25. The roller 26 is mounted on a vertically rotatable two-arm lever 27 spring-loaded by a spring 28 which presses the roller 26 against the shaft 26 to be frictionally rotated thereby.

The yarn 5 delivered out of the twister 3 and fed into the building motion 6 is controlled by the pickup lever 7 disposed between the delivery motion 4 and the building motion 6. The pickup lever 7 is defined by an L-shaped lever hinged on the frame 1. One end of the lever carries a roller 29 about which is entrained the yarn passing over a roller 30 rotatably mounted on the frame 1. If the yarn-forming process proceeds normally, the L-shaped lever is suspended by the yarn and held thereby.

The other end of the L-shaped lever is disposed adjacent a switch 31 coupled into the electric control circuit by an electromagnet 32.

The building motion is defined by a constantly rotating shaft 33 mounting a disk frictionally coupled with a drum 34 of a traverse motion, the latter being mounted in bearings on the shaft 33 with a package 35 being spring pressed thereagainst by a known means in order that the yarn may be wound thereon.

Adjacent the drum 34, a hinged lever 36 is mounted on the frame, with the lever 36 carrying a brake shoe 36*a* cooperating with the drum 34 should it be required to stop the building motion.

Each spinning arrangement of the frame incorporates a motion 37 for a simultaneous disconnection of the feed roller 11, the twister 3 and the building motion 6 as well as for their sequential actuation, with the motion 37 being coupled with the pickup lever 7 and controlled thereby.

The motion 37 comprises a bar 38 provided with means 39 and 40 for positively displacing the bar 38 in a vertical plane to two positions, e.g. upward and downward, to effect the disconnection and actuation, respectively, and a cylinder 41 with the spring-loaded bar 38 passing through a cavity 42 of the cylinder 41.

Figure 5:
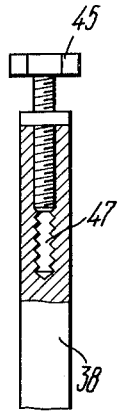
FIG. 5 is a partial section of part of a bar with a stop.

The bar 38 displaces in guides 43 and 44 disposed on the frame 1 and has two stops 45 and 46 mounted along the length of the bar 38 at a distance one from the other. The stop 46 is fixed on the bar 38 and is in constant cooperation with motion 24 for retracting the flexible coupling 21 from the shaft 20 of the twister 3. The stop 45 is defined by a screw threadedly received in a hole 47 (FIG. 5) formed in the end of the bar 38. By turning the screw, the distance between the stops 45 and 46 is varied in order to provide for a sequential actuation of the feed roller 12 and the twister 3.

The stop 45 (FIG. 2) is designed to cooperate with the clutch 14 of the feeding arrangement 3 via an L-shaped lever 48 pivotally mounted on the frame 1 on a revolving axle 49. One arm of the lever 48 cooperates with the semi-clutch 17 of the clutch 14. In the other arm of the lever 48, there is formed a longitudinal slot 50 through which the bar 38 passes, with the lever 48 being so positioned that the arm through which the bar 38 passes is disposed adjacent the stop 45 in order to cooperate therewith while the bar 38 is in motion.

The bar 38 (FIG. 4) is pressed against the cylinder 41 (FIG. 4) by a spring 51 which rests with one end against projections 52 secured on the inner surface of the cylinder 41 and against a projection 53 secured on the bar 38.

The cylinder 41 incorporates guides 54 and 55 in which the bar 38 moves, with the guides 54 and 55 preventing the cylinder 41 from moving radially with respect to the bar. The cylinder 41 is adapted to move together with the bar 38 to one of the positions thereof, viz. downward to the position in which the feed roller 11, the twister 3 and the building motion 6 are disconnected. To make such a joint movement possible, the bar 38 with the cylinder 41 are interconnected by a pin 56 (FIGS. 6 and 7) secured on the bar 38, the cylinder 41 having a longitudinal slot 57 accomodating the pin 56.

The cylinder 41 (FIG. 4) has a stop 58 for cooperating with the lever 36 of the brake shoe 36a of the building motion 6, as well as a means 59 for temporarily restraining the cylinder 41 from accompanying the bar 38 to its other position, viz. upward to the position in which the building motion 6 is actuated after the feeding arrangement 2 and the twister 3 have been placed into operation.

Figure 8:
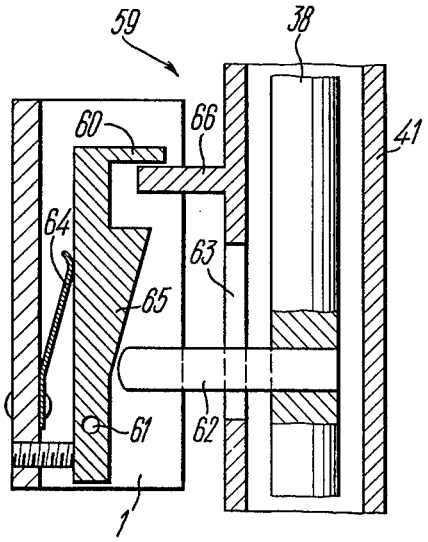
FIG. 8 is a partial section of a means for temporarily restraining the cylinder from displacing together with the bar.

The means 59 (FIG. 8) for temporarily preventing the cylinder 41 from moving jointly with the bar 38 comprises a catch 60 pivotally mounted on an axle 61 in the frame 1, a pusher 62 secured on the bar 38 and extending beyond the cylinder 41 through a longitudinal cut-out 63 in the cylinder 41. The catch 60 is pressed against the cylinder 41 by a flat spring 64, with one end thereof being rigidly secured on the frame 1 and the other end resting against the catch 60, and the catch 60 has a wedge-shaped projection 65 with which the pusher 62 of the bar 38 cooperates.

On the cylinder 41, there is provided a projection 66 cooperating with the catch 60 for restraining the cylinder 41 as the bar 38 is moving upward until the catch 60 is retracted from the projection 66 by the pusher 62.

In addition, there is an auxiliary stop 67 provided in the upper portion of the cylinder 41 (FIG. 4) on a cylinder projection 68, with the stop 67 being cooperable with the lever 27 of the delivery motion 4.

The means 40 for positively displacing the bar 38 upward to the position of actuation of the feeding arrangement 2, the twister 3 and the building motion 6 is defined by a handle hinged on the frame 1 and resting against a pin 69 secured on the bar 38.

The means 39 (FIG. 7) for positively displacing the bar 38 downward to the position of disconnection in case of a slack or breakage may be made in a variety of designs. In one of the possible embodiments, the means 39 comprises a gib 70, a load-bearing member 71 and a three-arm lever 72.

Figure 6:
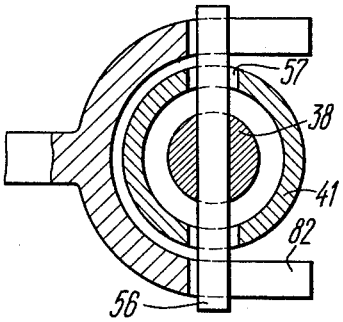
FIG. 6 is a view taken on the line VI—VI of FIG. 4.
Figure 7:
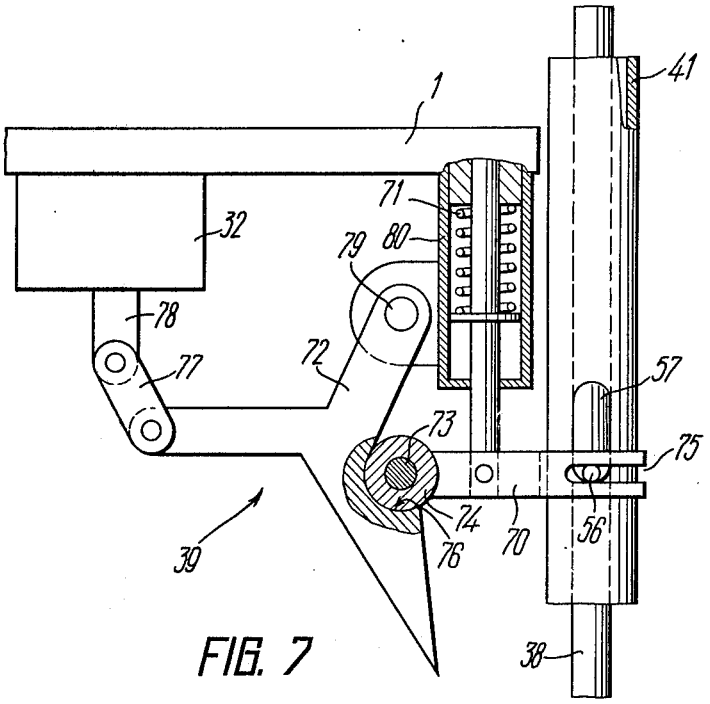
FIG. 7 is a view, partially in section, of a means for positively displacing the bar to the disonnection position thereof.

At one end of the gib 70, there is disposed an axle 73 carrying a roller 74, whereas the other end of the gib 70 is provided with a fork enveloping the cylinder 41 as shown in FIG. 6, with slots 75 formed in the prongs of the fork to receive the pin 58 of the bar 38 (FIG. 7).

The central portion of the gib 70 is connected with the load-bearing member 71 which may be a compression spring as shown in FIG. 7, or an electromagnet, a pneumatic or hydraulic cylinder.

The three-arm lever 72 has a depression 76 formed in the central portion of the lever in which the roller 74 of the gib 70 is accomodated, and one arm of the lever 72 is coupled by a link 77 with an armature 78 of the electromagnet 32. Another or second arm is pivotally mounted on an axle 79 on a case 80 of the load-bearing member 71 mounted on the frame 1, and the third arm of the lever is a free one serving as a guide carrying the roller 74 emerging from the depression 76 as the lever 72 turns.

In another embodiment, the means 39 is constitutedly a lever 81 (FIG. 4), with one end thereof being pivotally mounted on the frame 1 while the other end formed, similarly to the fork of the gib 70, as a fork enveloping the cylinder 41, as described hereinabove and shown in FIG. 7.

The lever 81 is provided with projections 82, 83 and 84, with the projection 82 being disposed adjacent a switch 85 electrically coupled into the control circuit of the electromagnet 32 in series with the switch 31. The projection 83 is hinged with the armature 78 of the electromagnet 32; and the projection 84 is coupled with an extension spring 86.

The shafts 10 (FIG. 1), 13, 23 (FIG. 3), 25 (FIG. 1), 33 and 87, with the latter rotating the combing roll 12 via a belt drive, are driven into rotation by a conventional method from a common drive (not shown) in the figures as being widely known in textile engineering.

The frame of this invention operates as follows:

The common drive of the frame is actuated, thereby imparting rotation to the shafts 10, 13, 23, 25, 33 and 87.

The rotating shaft 10 and feed roller 11 supply the sliver or roving along the trough 9 into the feeding arrangement 2 wherein the sliver is separated into individual fibers which are fed into the twister 3 in which the fibers are formed into the yarn 5 delivered out of the twister 3 by the motion 4 and wound on the package 35.

Figure 4:
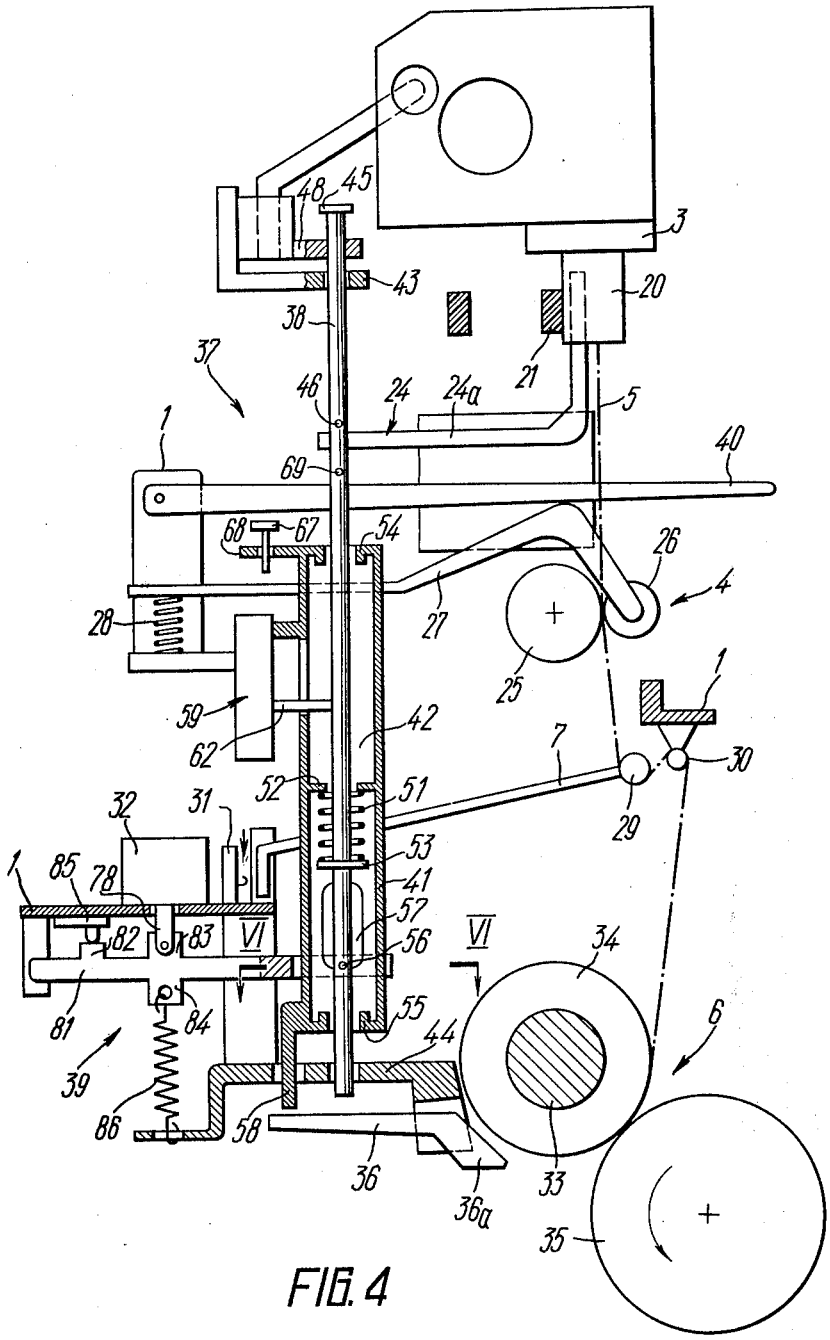
FIG. 4 is a view in side elevation of a mechanism for actuating and disconnecting the spinning arrangement motions, the view being partly in cross-section.

The yarn 5 emerging from the motion 4 goes around the freely rotating roller 30 and matintains the pickup lever 7 in a position such that its end is clear of the electric switch 31 (FIG. 4). At the same time, the projection 82 of the lever 81 cooperates with the electric switch 85, closing the electric control circuit of the electromagnet 32, with the result that the lever 81 is kept by the electromagnet 32 in its upper position and, via the pin 56, holds the bar 38 and the cylinder 41 in the upper position for actuating the feed roller 11, the twister 3 and the motion 4 and 6.

In case the bar 38 and the cylinder 41 are positively displaced by use of the three-arm lever 72 (FIG. 7) and the load-bearing member 71, the lever 72 is so disposed that its axle 79 and the axle 73 of the roller 74 are vertically aligned, and the roller 74 is disposed in the depression 76 of the lever 72, thereby keeping the bar 38 in its upper position via the gib 70 and the pin 56.

If the yarn 5 (FIG. 4) breaks or is positively slackened, the lever 7 turns, with its end actuating the electric switch 31 which opens the control circuit of the electromagnet 32, with the result that the armature 73 of the electromagnet 32 no longer restrains the lever 81 which is urged by the spring 86 to rotate around its axle, with the projection 82 of the lever 81 retiring from the switch 85 series-coupled into the electric control circuit of the electromagnet 32. While rotating, the lever 81 acts on the pin 56 to lower the bar 38 and the cylinder 41 to the disconnection position.

The pusher 62 (FIG. 8) moving together with the bar 38 downward, down the wedge-shaped projection 65, releases the catch 60 which is urged by the spring 64 toward the cylinder 41 to come into contact with the projection 66 of the cylinder 41, with the stop 45 (FIG. 2) of the bar 38 turning the lever 48 which acts on the semiclutch 17, retracting the same from the semiclutch 15, thereby throwing the clutch 14 out of mesh, with the result that rotation is no longer transmitted from the shaft 13 to the feed roller 11, thereby preventing sliver feed to the feeding arrangement 2. The stop 46 (FIG. 4) of the bar 38 acts on the lever of the motion 24 which turns, thus retracting the flexible coupling 21 from the shaft 20 of the twister 3 and thereby preventing rotation from being transmitted thereto.

The cylinder 41, having moved together with the bar 38 downward, acts by way of the stop 67 on the lever 27 which turns, retracting the roller 26 from the shaft 25, whereas the stop 58 of the cylinder 41 turns the lever 36 which cooperates by way of the brake shoe 36a with the drum 34, thereby stopping the same and preventing the yarn from being wound on the package 35.

In order to resume the spinning process, the end of the yarn 5 from the package 35 in introduced through the channel of the shaft 20 into the twister 3, with the yarn 5 being positioned intermediate the shaft 25 and the roller 26 and running over the roller 30. Then, the pickup lever 7 is turned so that its roller 29 is disposed on the yarn 5, and the yarn 5 is tautened betweeen the shafts 25 and 33. As the pickup lever 7 turns, its end breaks contact with the switch 31 so that the latter closes the electric control circuit of the electromagnet 32.

Then, the handle 40 is turned against the action of the springs 51 and 86, moving the bar 38 upward, i.e. to the position of actuation of the spinning arrangement motions, with the handle 40 abutting against the pin 69 and driving upward the bar 38 alone, as the cylinder 41 (FIG. 8) is held in place by the catch 60 cooperating with the projection 66 of the cylinder 41. The stop 45 (FIG. 4) retires from the lever 48 turned by the semiclutch 17 (FIG. 2) which is driven by the spring 88 into engagement with the semiclutch 15, with the result that the feed roller 11 starts rotating, feeding the sliver to the combing roll 12. While the feed roller 11 is feeding the sliver and the twister 3 is being filled with fibers, the stop 46 is caused by the upward displacement of the bar 38 to retire from the lever of the motion 24 for retracting the flexible coupling 21, the latter lever turns and the flexible coupling 21 returns to the initial position, coming in contact with the shaft 20 of the twister 3 and thereby imparting rotation thereto. As the twister 3 rotates, the fibers are pieced up with the yarn left therein. By this time, in the course of the upward displacement of the bar 38, the pusher 62 (FIG. 8) of the bar 38 travels up the wedge-shaped projection 65, retracting the catch 60 from the stop 66 of the cylinder 41. As a result, the cylinder 41 is driven by the compressed springs 51 (FIG. 4) upward so that the stops 67 and 58 of the cylinder 41 break contact with the levers 27 and 36, respectively, the lever 24 turning by the action of the spring 28 and the roller 26 of the lever 24 abutting against the rotating shaft 25, whereas the lever 36 turns, retracting the brake shoe 36a from the drum 34 which, acted upon by the rotating shaft 33, starts rotating, driving into rotation the package 35 pressed thereagainst, so that the yarn 5 starts winding on the package 35. Thus, is the process of spinning, i.e. formation of the yarn 5 in the spinning arrangement, resumed.

At the instant the bar 38 is set to its upper position, the pin 56 of the bar 38 turns the lever 81 and the projection 82 thereof acts on the electric switch 85, thereby closing the electric control circuit of the electromagnet 32. The armature 78 of the electromagnet 32 restrains the lever 81, and thereby the bar 38 and the cylinder 41, in the upper position in which all the motions of the spinning arrangement are operating. Then, the handle 40 is lowered to the initial position, i.e. retracted from the pin 69 of the bar 38.

In the case the three-arm lever 72 is used, as the bar 38 and the cylinder 41 move upward, the roller 74 of the gib 70 likewise moves upward and is received into the depression 76 of the lever 72, securely locking the bar 38 and the cylinder 41 in the upper position.

What is claimed is:

1. An open-end spinning frame comprising a plurality of spinning arrangements, each of which comprises: a combing drive roll; a feed roller; a means for rotating said feed roller; a clutch to transmit rotation from said means to said feed roller; a twister having a shaft provided with a flexible coupling running thereover to impart rotation thereto; a motion for retracting said flexible coupling from the twister shaft; a motion for delivering the yarn out of said twister installed beneath said twister; s building motion provided with a brake member; a yarn tension pickup lever disposed intermediate said building motion and said delivery motion; a motion for simultaneously disconnecting and sequentially actuating said feed roller, twister and building motion incorporating a bar displacable to two positions for disconnection and actuation, respectively, and a hollow cylinder, with said bar running through said hollow cylinder, a means for spring-urging said bar to said cylinder; a means for positively displacing said bar in a vertical plane to one of said positions to effect said disconnection; a means positively displacing said bar in a vertical plane to the other of said positions to effect said actuation; a stop mounted on the bar and adapted to cooperate with said feed roller clutch in the two positions of said bar; another stop mounted on the bar and adapted to cooperate with said motion for retracting said flexible coupling from the twister shaft; said cylinder being linked with the bar in order to be able to travel therewith to said disconnection position thereof; a stop provided on said cylinder and adapted to cooperate with the brake member of the building motion; and a means for temporarily restraining the cylinder from accompanying the bar in the travel thereof to the position of actuation of the building motion in the course of resumption of operation of the spinning arrangement.

2. The spinning frame as claimed in claim 1, in which, to provide for the joing displacement of the bar and the cylinder, there is a longitudinal slot in the cylinder and the bar carries a pin fitting into the longitudinal slot.

3. The spinning frame as claimed in claim 1, in which the means for temporarily restraining the cylinder from travelling together with the bar comprises a catch pivotally mounted on the frame, said catch being spring-urged to the cylinder and having a wedge-shaped projection, a pusher secured on the bar and cooperating with the wedge-shaped projection, said pusher extending beyond the cylinder through a longitudinal cut-out therein, and a projection provided on the cylinder with which the catch cooperates, restraining the cylinder while the bar is in motion until the pusher retracts the catch from the cylinder projection.

4. The spinning frame as claimed in claim 1, in which the means for positively displacing the bar to the disconnection position comprises a gib having a roller at one end thereof and coupled with the bar by way of the other end thereof, a load-bearing member coupled with the gib, and a spring-loaded three-arm lever having a depression in a central portion thereof to accomodate the gib roller, and one arm of said lever being hinged with an armature of an electromagnet electrically coupled, via a switch, to the yarn tension pickup lever.

5. The spinning frame as claimed in claim 1, in which the means for positively displacing the bar to the actuation position is defined by a handle pivotally mounted on the bar of the frame and resting against a pin on the bar.

6. The spinning frame as claimed in claim 2, in which the cylinder is provided with an auxiliary stop adapted to cooperate with the delivery motion as the same is actuated or disconnected while the cylinder is being displaced.

* * * * *